United States Patent [19]

Meier

[11] Patent Number: 5,009,619

[45] Date of Patent: Apr. 23, 1991

[54] CORROSION PROTECTION SYSTEM

[75] Inventor: Peter W. Meier, Stuart, Fla.

[73] Assignee: Outboard Marine Corporation, Waukegan, Ill.

[21] Appl. No.: 402,521

[22] Filed: Sep. 5, 1989

[51] Int. Cl.[5] ..... B63H 5/12

[52] U.S. Cl. ..... 440/53; 248/641; 440/52; 440/113

[58] Field of Search ..... 440/52, 53, 113, 900; 248/632–635, 638, 640–643; 114/356

[56] References Cited

U.S. PATENT DOCUMENTS

| | | | |
|---|---|---|---|
| 2,764,119 | 9/1956 | Sigler | 115/17 |
| 2,928,630 | 4/1960 | Wisman | 248/4 |
| 3,845,923 | 11/1974 | Atkinson | 248/3 |
| 4,271,548 | 6/1981 | Alberts | 440/113 |
| 4,367,860 | 1/1983 | Strang | 248/641 |
| 4,448,387 | 5/1984 | Gilbreath | 248/642 |
| 4,482,330 | 11/1984 | Cook | 440/2 |
| 4,507,090 | 4/1985 | Kobayashi et al. | 440/52 |
| 4,669,698 | 1/1987 | McGuire | 248/641 |
| 4,708,087 | 11/1987 | Potter, Jr. | 114/352 |

*Primary Examiner*—Sherman Basinger

[57] ABSTRACT

A marine installation including a transom fabricated of a first metal and including a forward surface, a rearward surface, and a mounting opening extending between the surfaces, and a marine propulsion device including a transom bracket fabricated of a second metal less noble than the first metal, and a mechanism for detachably mounting the transom bracket on the transom and for simultaneously electrically insulating the transom bracket from the transom, which mechanism includes a sleeve fabricated of electrically insulating material and engaged in the mounting opening and having therein a bore, a sheet fabricated of electrically insulating material and engaged with the rearward surface and with the sleeve and having therein an opening in registry with the bore, a washer fabricated of electrically insulating material and engaged with the forward surface and with the sleeve and having therein an aperture in registry with the bore, and a bolt having a head engaging the washer, extending through the aperture, through the bore, through the opening in the sheet, and connected to the transom bracket to locate the transom bracket in engagement with the sheet and in rigid assembly with and in electrical isolation from the transom.

13 Claims, 2 Drawing Sheets

CORROSION PROTECTION SYSTEM

BACKGROUND OF THE INVENTION

1. Field of the Invention

The invention relates to marine propulsion devices and, more particularly, to outboard motors which are mounted on metal boat transoms, or on metal transom extension brackets.

Still more particularly, the invention also relates to anodic protection systems and to such protection systems with stainless steel or other metallic transom extension brackets or with boats having metal transoms or metallic paints.

2. Reference to Prior Art

In the past, lower unit gear cases have sometimes corroded to the point that holes have developed in the gear cases permitting water to enter into the ordinarily sealed interior of such gear cases, with the result that such gear cases had to be replaced. Such occurrences have happened when conventional outboard motor have been conventionally mounted on metal transoms, or on transom extension brackets fabricated as stainless steel or other metals.

Attention is directed to the following U.S. Pat. Nos.:

| | | |
|---|---|---|
| 2,764,119 | Sigler | September 25, 1956 |
| 2,928,630 | Wisman | March 15, 1960 |
| 3,845,923 | Atkinson | November 5, 1974 |
| 4,271,548 | Alberts | June 9, 1981 |
| 4,367,860 | Strang | January 22, 1983 |
| 4,482,330 | Cook | November 13, 1984 |
| 4,507,090 | Kobayaski, et al | March 26, 1985 |
| 4,669,698 | McGuire | June 2, 1987 |
| 4,708,087 | Potter, Jr. | November 24, 1987 |

SUMMARY OF THE INVENTION

The invention provides a marine installation including a transom fabricated of a first metal and including a forward surface, a rearward surface, and a mounting opening extending between the surfaces, and a marine propulsion device including a transom bracket fabricated of a second metal less noble than the first metal, and means for detachably mounting the transom bracket on the transom and for simultaneously electrically insulating the transom bracket from the transom, which means includes a sleeve fabricated of electrically insulating material and engaged in the mounting opening and having therein a bore, a sheet fabricated of electrically insulating material and engaged with the rearward surface and with the sleeve and having therein an opening in registry with the bore, a washer fabricated of electrically insulating material and engaged with the forward surface and with the sleeve and having therein an aperture in registry with the bore, and a bolt having a head engaging the washer extending through the aperture, through the bore, through the opening in said sheet, and connected to the transom bracket to locate the transom bracket in engagement with the sheet and in rigid assembly with and in electrical isolation from the transom.

The invention also provides a marine propulsion installation including a transom bracket fabricated of a first metal, a transom fabricated of a second metal more noble than the first metal, having a forward surface, a rearward surface, and a mounting opening extending between the surfaces, a sleeve fabricated of electrically insulating material and engaged in the mounting opening and having therein a bore, a sheet fabricated of electrically insulating material and engaged with the rearward surface and with the sleeve and having therein an opening in registry with the bore, a washer fabricated of electrically insulating material and engaged with the forward surface and with the sleeve and having therein an aperture in registry with the bore, and a bolt having a head engaging the washer, extending through the aperture, through the bore, through the opening in said sheet, and connected to the transom bracket to locate the transom bracket in engagement with the sheet and in rigid assembly with and in electrical isolation from the transom.

The invention also provides a marine installation including a transom fabricated of a first metal and including a forward surface, a rearward surface, an upper surface, and a mounting opening extending between the forward and rearward surfaces, and a marine propulsion device including a transom bracket fabricated of a second metal less noble than the first metal, and means for detachably mounting the transom bracket on the transom and for simultaneously electrically insulating the transom bracket from the transom, which means includes a sleeve fabricated of electrically insulating material, engaged in the mounting opening, having a first end and a second end, and having therein a bore, a sheet fabricated of electrically insulating material and engaged with the rearward surface and with the first end of the sleeve and having therein an opening in registry with the bore, a washer fabricated of electrically insulating material, engaged with the forward surface and with the second end of the sleeve, and having therein an aperture in registry with the bore, a strip fabricated of electrically insulating material and engaged with and between the upper surface and the mounting bracket, and a member fabricated of electrically insulating material and engaged with and between the forward surface and the mounting bracket, said sheet and said strip and said member forming portions of a unitary piece of electrically insulating material, and a bolt having a head engaging the washer, extending through the aperture, through the bore, through the opening in the sheet, and connected to the transom bracket to locate the transom bracket in engagement with the sheet and in rigid assembly with and in electrical isolation from the transom.

Other features and advantages of the invention will become apparent to those skilled in the art upon review of the following detailed description, claims, and drawings.

THE DRAWINGS

Figure 1:
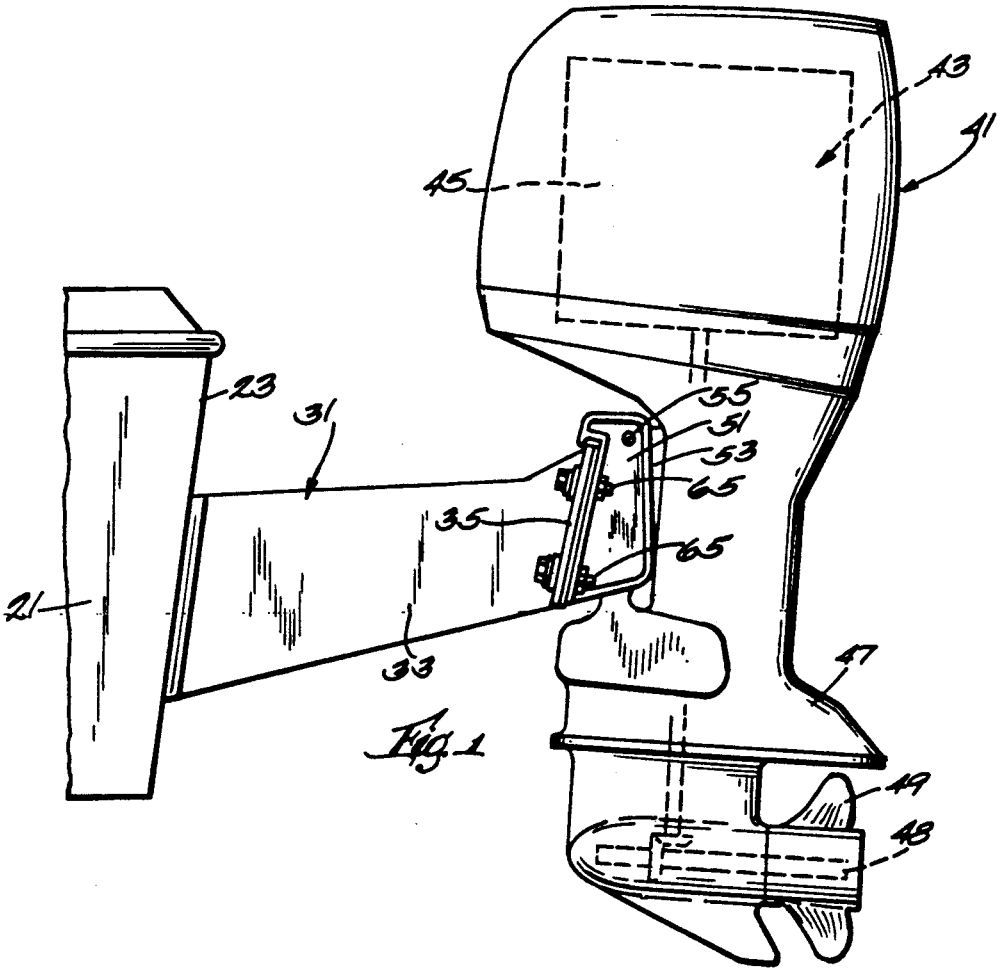
FIG. 1 is a fragmentary elevational view of a marine installation embodying various of the features of the invention.
Figure 2:
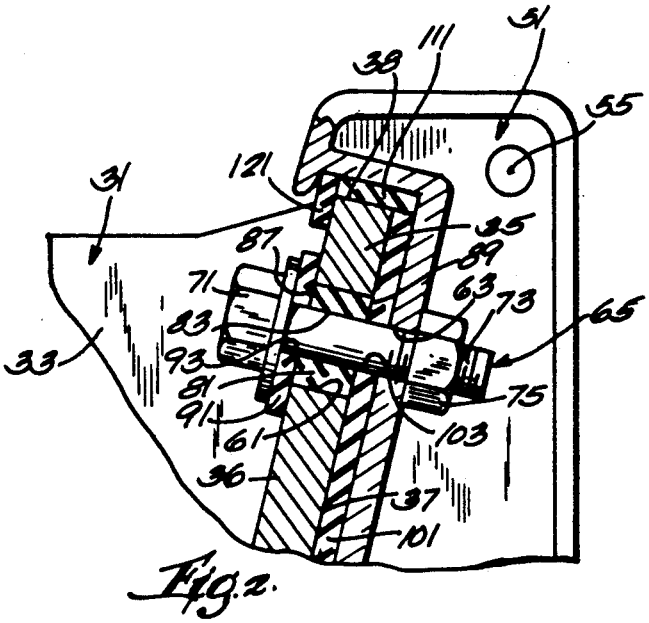
FIG. 2 is an enlarged fragmentary view, partially in section, of a portion of the marine installation shown in FIG. 1.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in the drawings is a marine installation including a boat hull 21 having a transom 23. The boat hull 21 and/or the transom 23 can be of metal and/or can be painted with a metallic paint.

Fixedly connected to the boat transom 23 by any suitable means, such as by a series of bolts (not shown), is a transom extension bracket 31 including one or more rearwardly extending arms 33 and a second or rearwardly spaced false transom 35 which is connected to the rearwardly extending arm or arms 33 and which includes a front or forward surface 36, a back or rearward surface 37, and an upper top surface 38 extending between the forward surface 36 and the rearward surface 37.

The transom extension bracket 31 can be metallic and, in particular, as in the past, can be fabricated of stainless steel. The term "transom" used in the claims refers without the boat transom 23 or the false transom 25.

Mounted on the false transom 35 of the extension bracket 31 is a marine propulsion device in the form of an outboard motor 41 which includes a propulsion unit 43 including an internal combustion engine 45, and a drive shaft housing 47 supporting a propeller shaft 48 driven by the engine 45 and carrying a propeller 49, together with mounting means including a transom mounting bracket 51, and a swivel bracket 53 connected to the transom mounting bracket 51 for tilting movement relative thereto about a horizontal axis 55 and connected to the propulsion unit 43 to afford common tilting movement of the propulsion unit 43 with the swivel bracket 53 relative to the transom bracket 51 and to afford pivotal steering movement of the propulsion unit 43 relative to the swivel bracket 53. The transom bracket 51, the swivel bracket 53 and the drive shaft housing 47 are commonly fabricated of aluminum which is a less noble metal as compared to stainless steel.

Means are also provided for detachably securing the transom mounting bracket 51 to the false transom 35 of the extension bracket 31 and for electrically insulating the transom extension bracket 31 from the transom mounting bracket 51.

While other constructions can be employed, it is common to detachably bolt the transom bracket 51 to the transom extension bracket 31. For this purpose, the false transom 35 of the extension bracket 31 includes a plurality of bolt holes 61 arranged in a given pattern, and the transom mounting bracket 51 is similarly provided with a like plurality of mounting openings or bolt holes 63 arranged in a like pattern. In addition, a like plurality of mounting studs or bolts 65 extend through the mounting openings 61 in the false transom 35 and in the mounting openings 63 in the transom mounting bracket 51. While various pluralities can be employed, in the disclosed construction, four such bolts 65 are employed. The bolts 65 are generally identical and each bolt 65 includes an enlarged head 71 located adjacent the forward surface 36 of the false transom 35 of the extension bracket 31 and an extending stud portion 73 which is threadedly engaged with a nut 75 located rearwardly of the transom mounting bracket 51.

The mounting and electrical insulating means also includes, with respect to each bolt 65, a sleeve 81 which is formed of insulating material, which has a bore 83 through which the associated one of the stud portions 73 extends, which is located in the associated one of the mounting openings 61 in the false transom 35 of the extension bracket 31, and which has opposite forward and rearward ends 87 and 89.

In addition, the mounting and electrical isolating means includes, with respect to each bolt 65, a washer 91 which is fabricated of insulating material, which has an opening 93 through which passes the stud portion 73 of the associated bolt 65, which is sandwiched in engaged relation between the head 71 of the associated bolt 65 and the forward surface 36 of the false transom 35 of the extension bracket 31, and which engages the forward end 87 of the sleeve 81.

In addition, the mounting and electrical insulating means includes a sheet 101 which is fabricated of electrical insulating material, which includes a like plurality of openings 103 in registry with the mounting openings 61 and 63 in the false transom 35 of the extension bracket 31 and in the transom mounting bracket 51 and through which the bolts 65 pass, and which is sandwiched in engaged relation between the rearward surface 37 of the false transom 35 of the extension bracket 31 and the transom mounting bracket 51 and which also engages the other or rearward end 89 of the sleeve 81.

Still further in addition, the mounting and electrical insulating means includes a strip 111 fabricated of insulating material and located in engaged relation with and between the upper surface 38 of the false transom 35 of the extension bracket 31 and the adjacent surface of the transom mounting bracket 51. The strip 111 also abuts the sheet 101 either by reason of the sheet 101 engaging an end surface of the strip 111 or by reason of the strip 111 engaging an end surface of the sheet 101.

If the transom mounting bracket 51 includes any portion engaging the forward surface 36 of the false transom 35 of the extension bracket 31, a member 121 fabricated of insulating material can be sandwiched between the forward surface 36 of the false transom 35 of the extension bracket 31 and transom mounting bracket 51 in the area of such engagement.

Figure 3:
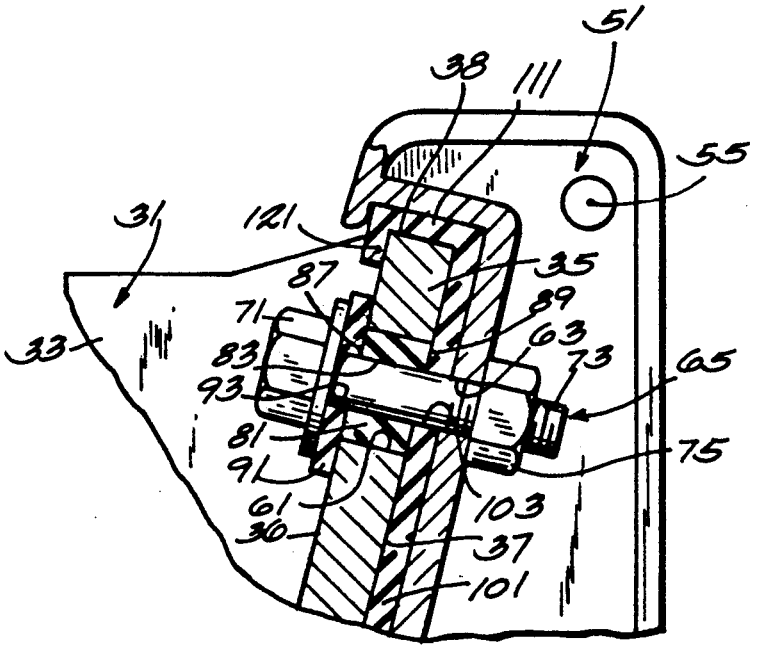
FIG. 3 is a view similar to FIG. 2 showing an alternative embodiment of the invention.

If desired, and as shown in FIG. 3 the previously mentioned sheet 101 can be flexible and could be extended over the upper surface 38 of the false transom 35 and then downwardly along the forward surface 36 of the false transom 35 as far as may be desirable, thereby providing the sheet 101, the strip 111, and the member 121 in one unitary piece of electrically insulating material.

As a consequence of the foregoing, the transom mounting bracket 51 of the outboard motor 41 is electrically insulated from the false transom 35 of the extension bracket 31 and/or from the boat transom 23 itself, thereby preventing a galvanic circuit between the false transom 35 of the extension bracket 31 and/or the boat transom 23 with the outboard motor 41 and thereby reducing possible dissolution of metal from the outboard motor 41 because of the presence in the boat hull 21 or in the extension bracket 31 of more noble metal and because of electrical connection between the metal of the outboard motor 41 and the more noble metal of the extension bracket 31 and/or the boat transom 23.

Various of the features of the invention are set forth in the following claims.

We claim:

1. A marine installation including a transom fabricated on a first metal and including a forward surface, a rearward surface, and a mounting opening extending between said surfaces, and a marine propulsion device including a transom bracket fabricated of a second metal less noble than said first metal, and means for detachably mounting said transom bracket on said transom and for simultaneously electrically insulating said transom bracket from said transom, said means including a sleeve fabricated of electrically insulating material and engaged in said mounting opening and having therein a bore, a sheet fabricated of electrically insulating material and engaged with said rearward surface and with said sleeve and having therein an opening in registry with said bore, a washer fabricated of electrically insulating material and engaged with said forward surface and with said sleeve and having therein an aperture in registry with said bore, and a bolt having a heat engaging said washer, extending through said aperture, through said bore, through said opening in said sheet, and connected to said transom bracket to locate said transom bracket in engagement with said sheet and in rigid assembly with and in electrical isolation from said transom.

2. A marine installation in accordance with claim 1, wherein said transom includes an upper surface, and further including a strip fabricated of electrically insulating material and engaged with and between said upper surface and said transom bracket.

3. A marine installation in accordance with claim 2 wherein one of said sheet and said strip has an end surface engaged with the other of said sheet and said strip.

4. A marine installation in accordance with claim 2 wherein said sleeve has a first end in abutting engagement with said washer and second end in abutting engagement with said sheet.

5. A marine installation in accordance with claim 1 and further including a member fabricated of electrically insulating material and engaged with and between said forward surface and said transom bracket.

6. A marine installation in accordance with claim 1 wherein said transom includes an upper surface and further including a strip fabricated of electrically insulating material and engaged with and between said upper surface and said transom bracket, and a member fabricated of electrically insulating material and engaged with and between said forward surface and said transom bracket, and wherein said sheet, said strip and said member form portions of a unitary piece of electrically insulating material.

7. A marine propulsion installation including a transom bracket fabricated of a first metal, a transom fabricated of a second metal more noble than said first metal, having a forward surface, a rearward surface, and a mounting opening extending between said surfaces, a sleeve fabricated of electrically insulating material and engaged in said mounting opening and having therein a bore, a sheet fabricated of electrically insulating material and engaged with said rearward surface and with said sleeve and having therein an opening in registry with said bore, a washer fabricated of electrically insulating material and engaged with said forward surface and with said sleeve and having therein an aperture in registry with said bore, and a bolt having a head engaging said washer, extending through said aperture, through said bore, through said opening in said sheet, and connected to said transom bracket to locate said transom bracket in engagement with said sheet and in rigid assembly with and in electrical isolation from said transom.

8. A marine installation in accordance with claim 7, wherein said transom includes an upper surface, and further including a strip fabricated of electrically insulating material and engaged with and between said upper surface and said transom bracket.

9. A marine installation in accordance with claim 8 wherein one of said sheet and said strip has an end surface engaged with the other of said sheet and said strip.

10. A marine installation in accordance with claim 8 wherein said sleeve has a first end in abutting engagement with said washer and second end in abutting engagement with said sheet.

11. A marine installation in accordance with the claim 7 and further including a member fabricated of electrically insulating material and engaged with and between said forward surface and aid transom bracket.

12. A marine installation in accordance with claim 7 wherein said transom includes an upper surface and further including a strip fabricated of electrically insulating material and engaged with and between said upper surface and said transom bracket, and a member fabricated of electrically insulating material and engaged with and between said forward surface and said transom bracket, and wherein said sheet, said strip and said member form portions of a unitary piece of electrically insulating material.

13. A marine installation including a transom fabricated of a first metal and including a forward surface, a rearward surface, an upper surface, and a mounting opening extending between said forward and rearward surfaces, and a marine propulsion device including a transom bracket fabricated of a second metal less noble than said first metal, and means for detachably mounting said transom bracket on said transom and for simultaneously electrically insulating said transom bracket from said transom, said means including a sleeve fabricated of electrically insulating material, engaged in said mounting opening, having a first end and a second end, and having therein a bore, a sheet fabricated of electrically insulating material and engaged with said rearward surface and with said first end of said sleeve and having therein an opening in registry with said bore, a washer fabricated of electrically insulating material, engaged with said forward surface and with said second end of said sleeve, and having therein an aperture in registry with said bore, a strip fabricated of electrically insulating material and engaged with and between said upper surface and said transom bracket, and a member fabricated of electrically insulating material and engaged with and between said forward surface and said transom bracket, said sheet and said strip and said member forming portions of a unitary piece of electrically insulating material, and a bolt having a heat engaging said washer, extending through said aperture, through said bore, through said opening in said sheet, and connected to said transom bracket to locate said transom bracket in engagement with said sheet and in rigid assembly with and in electrical isolation from said transom.

* * * * *